US010513419B2

(12) United States Patent
Cao et al.

(10) Patent No.: US 10,513,419 B2
(45) Date of Patent: Dec. 24, 2019

(54) SLOPE-ADAPTIVE INCLINED SPECIAL ELEVATOR

(71) Applicants: DONGNAN ELEVATOR CO, LTD, Suzhou (CN); CHINA UNIVERSITY OF MINING AND TECHNOLOGY, Xuzhou (CN)

(72) Inventors: Guohua Cao, Xuzhou (CN); Zhencai Zhu, Xuzhou (CN); Lei Wei, Xuzhou (CN); Jiancong Qin, Xuzhou (CN); Xiaoguang Bo, Xuzhou (CN); Weihong Peng, Xuzhou (CN); Yiping Ma, Xuzhou (CN); Lei Wang, Xuzhou (CN)

(73) Assignees: DONGNAN ELEVATOR CO, LTD, Suzhou (CN); CHINA UNIVERSITY OF MINING AND TECHNOLOGY, Xuzhou (CN)

( * ) Notice: Subject to any disclaimer, the term of this patent is extended or adjusted under 35 U.S.C. 154(b) by 0 days.

(21) Appl. No.: 16/344,811

(22) PCT Filed: Dec. 22, 2015

(86) PCT No.: PCT/CN2015/098182
§ 371 (c)(1),
(2) Date: Apr. 25, 2019

(87) PCT Pub. No.: WO2017/071029
PCT Pub. Date: May 4, 2017

(65) Prior Publication Data

US 2019/0337762 A1 Nov. 7, 2019

(30) Foreign Application Priority Data

Oct. 27, 2015 (CN) ..... 2015 1 0706293

(51) Int. Cl.
*B66B 9/06* (2006.01)
*B66B 17/12* (2006.01)
*B66B 9/08* (2006.01)

(52) U.S. Cl.
CPC ..... *B66B 9/06* (2013.01); *B66B 9/0846* (2013.01); *B66B 17/12* (2013.01)

(58) Field of Classification Search
CPC .... B66B 7/02; B66B 9/06; B66B 9/08; B66B 9/0807; B66B 9/0846; B66B 9/16; B66B 9/193; B66B 17/12
See application file for complete search history.

(56) References Cited

U.S. PATENT DOCUMENTS 2,232,890 A * 2/1941 Stillwagon ..... B66B 9/187 187/246
3,592,294 A * 7/1971 Allen ..... B66B 9/16 187/241

(Continued)

FOREIGN PATENT DOCUMENTS

CN 201494989 U 6/2010
CN 204490262 U 7/2015

(Continued)

*Primary Examiner* — Minh Truong
(74) *Attorney, Agent, or Firm* — Gokalp Bayramoglu

(57) ABSTRACT

A slope-adaptive inclined special elevator includes a bumper, an elevator car system, a slope guide rail system, a counter-weight system, a traction machine, a governing rope governor, and a traction rope guiding wheel. The two ends of the traction rope are connected to the elevator car system and the counter-weight system respectively, and the traction rope is towed and lifted under the driving action of the traction machine and the guiding action of the traction rope guiding wheel; over-speed protection is realized by means of the governing rope governor and a safety gear linkage and the bumper; to adapt to slope variations, the car body is leveled automatically by an automatic leveling assembly, the (Continued)

traction rope is guided forcibly via traction rope lifting devices and traction rope pressing devices, and the governing rope is guided forcibly via governing rope lifting devices and governing rope pressing devices.

4 Claims, 2 Drawing Sheets

(56) References Cited

U.S. PATENT DOCUMENTS

| | | | | | |
|---|---|---|---|---|---|
| 4,026,388 | A * | 5/1977 | Creissels | B61B 9/00 | 187/245 |
| 4,979,593 | A * | 12/1990 | Watanabe | B66B 1/16 | 104/112 |
| 5,125,481 | A * | 6/1992 | Shibata | B66B 9/00 | 187/245 |
| 6,170,613 | B1 * | 1/2001 | Prive | B66B 9/187 | 187/239 |
| 6,460,657 | B1 * | 10/2002 | Isenburg | B66B 15/04 | 187/245 |
| 10,351,391 | B2 * | 7/2019 | Cao | | |

FOREIGN PATENT DOCUMENTS

| | | | |
|---|---|---|---|
| CN | 205076613 | U | 3/2016 |
| JP | 05186169 | A | 7/1993 |
| JP | H08104480 | A | 4/1996 |
| JP | H08324920 | A | 12/1996 |

* cited by examiner

SLOPE-ADAPTIVE INCLINED SPECIAL ELEVATOR

CROSS REFERENCE TO THE RELATED APPLICATIONS

This application is the national phase entry of International Application No. PCT/CN2015/098182, filed on Dec. 22, 2015, which is based upon and claims priority to Chinese Patent Application No. 201510706293.X, filed on Oct. 27, 2015, the entire contents of which are incorporated herein by reference.

TECHNICAL FIELD

The present invention relates to a slope-adaptive inclined special elevator, particularly to an inclined special elevator which operates along a variable slope or variable trajectory owing to the influence of the profile of a building or the operating conditions in a roadway.

BACKGROUND

As a modern transportation means, elevators take an important role in vertical transport of high-rise buildings. As a branch of special elevators, inclined elevators are applicable at tourist spots, in regions where the residential buildings are built on hillsides owing to limited availability of the urban area, in complex roadways, and applicable to routine maintenance and service of high towers and large bridges. Inclined elevators are applicable to transportation on slopes with varying gradients, break through the layout concept of conventional obliquely running containers. Hence, inclined elevators involve strong creativeness and uniqueness. As people's living standard is improved, inclined elevators for sightseeing and vertical transport in residential buildings have been widely applied at oblique hillside locations and in buildings. Utilizing inclined elevators, visitors can enjoy beautiful scenery, thanks to the advantages of inclined elevators, such as high transport capacity, high transport speed, and long transport range.

Inclined elevators are used more and more widely. However, most existing inclined elevators have a constant gradient, which is a severe constraint in the development of inclined elevators. At present, there are few applications of inclined special elevators that operate along a variable trajectory; in addition, such inclined special elevators essentially have a variable trajectory only in a section of the running path. It is an urgent task to develop an inclined elevator that has a continuous variable trajectory.

SUMMARY

Technical Problem

To solve the problems in the prior art, the present invention provides a slope-adaptive inclined special elevator, which has a simple and compact structure, and is safe and reliable.

Technical Scheme

The slope-adaptive inclined special elevator according to the present invention comprises a slope guide rail system arranged on a slope, an elevator car system, a counterweight system, traction rope lifting devices, traction rope pressing devices, a traction rope, traction rope guiding devices, a traction machine, a governing rope governor, governing rope pressing devices, a governing rope, governing rope lifting devices, and a governing rope tensioner; the slope guide rail system comprises a plurality of guide rail supports arranged at an interval on the slope, each guide rail support comprises two vertical support plates arranged symmetrically and two cross plates, an upper cross plate and a lower cross plate, connected between the two vertical support plates, elevator car guide rails are connected and fixed at the two sides of the upper cross plates of the plurality of guide rail supports, and counterweight guide rails are connected and fixed at the two sides of the lower cross plates; the elevator car system is arranged on the elevator car guide rails and operates in a horizontal attitude, a counterweight system connected with the elevator car system is arranged on the upper counterweight guide rails, the traction rope lifting devices are arranged on the upper and lower cross plates of the guide rail supports respectively in a start section of the slope, the traction rope pressing devices are arranged on the upper and lower cross plates of the guide rail supports respectively in the upper section of the slope, and the traction rope guiding devices are arranged on the upper and lower cross plates of the last guide rail support respectively in the upper section of the slope; forcible guiding is executed via the traction rope lifting devices, traction rope pressing devices, and traction rope guiding devices;

the elevator car system comprises a car body and a pulley block arranged on the bottom of the car body, front guide shoes and rear guide shoes which ride on the elevator car guide rails are arranged below the pulley block, one side of the front end between the car body and the pulley block is hinged to each other, the rear end of the car body is connected with an automatic leveling assembly, the bottom of the pulley block is connected with one end of the traction rope, and the other end of the traction rope is connected with the counterweight system;

the traction machine is arranged at the top of the slope, and drives the traction rope to lead the elevator car system to move upwards or downwards, the governing rope governor and a traction rope guiding wheel are arranged at the traction machine, and the traction rope controls the distance between the elevator car system and the counter-weight system via the traction rope guiding wheel; a door at slope bottom corresponding to the elevator car system when the elevator car system lands at the bottom part of the slope and a door at slope top corresponding to the elevator car system when the elevator car system lands at the top part of the slope are arranged at one side of the slope guide rail system, the governing rope lifting devices and the governing rope pressing devices are arranged at the other side of the slope guide rail system and are fixed to the ground, the governing rope is arranged above the governing rope lifting devices and below the governing rope pressing devices and forms a closed loop, the upper part of the governing rope is driven by the governing rope governor, and the lower part of the governing rope is tensioned via the governing rope tensioner.

A safety gear is arranged on the bottom of the elevator car system.

A bumper is arranged at the lower end of the slope guide rail system.

The counterweight system comprises a rear counterweight, a front counterweight hinged to the rear counterweight, and counterweight guide shoes arranged on the bottom of the rear counterweight and the bottom of the front counterweight respectively.

Beneficial Effects:

With the technical scheme described above, in the slope-adaptive inclined special elevator according to the present invention, the two ends of the traction rope are connected to the elevator car system and the counterweight system respectively, and the traction rope is towed and lifted under the driving action of the traction machine and the guiding action of the traction rope guiding wheel; over-speed protection is realized by means of the governing rope governor and the safety gear linkage and the bumper, to adapt to slope variations, the car body is leveled automatically by means of the automatic leveling assembly; the traction rope is guided forcibly via the traction rope lifting devices and the traction rope pressing devices, and the governing rope is guided forcibly via the governing rope lifting devices and the governing rope pressing devices, thus, the entire inclined elevator system can operate successfully in variable-slope occasions. With the development of slope-adaptive inclined elevators, the applicability of inclined elevators is greatly improved, inclined elevators are applicable in variable-slope regions, and the application domain of inclined elevators is greatly expanded, and inclined elevators have obtained a wider development space, with inclined elevators, reliable transportation under complex and varying topographical conditions is realized. Compared with the prior art, the present invention solves the technical challenge of continuous variable trajectory of inclined elevator, and provides an inclined elevator that can operate smoothly and successfully along a complex and variable trajectory. The entire system is simple in structure, safe and reliable, easy maintenance, has the functions of ordinary elevators, and supports normal traction and lifting; the slope-adaptive inclined elevator is adaptive to complex and variable slope application occasions, expands the application domain of inclined elevators, and has high practicability.

Figure 1:
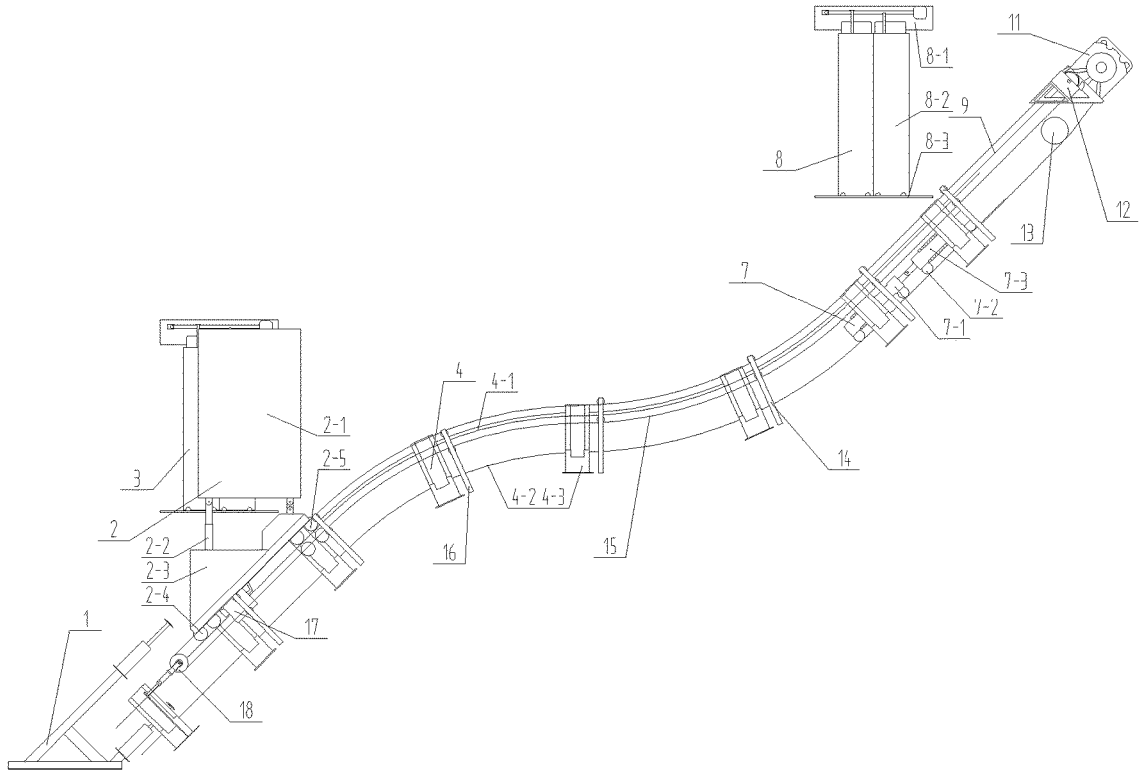
FIG. 1 is a front view of installation of the entire traction system according to the present invention.
Figure 2:
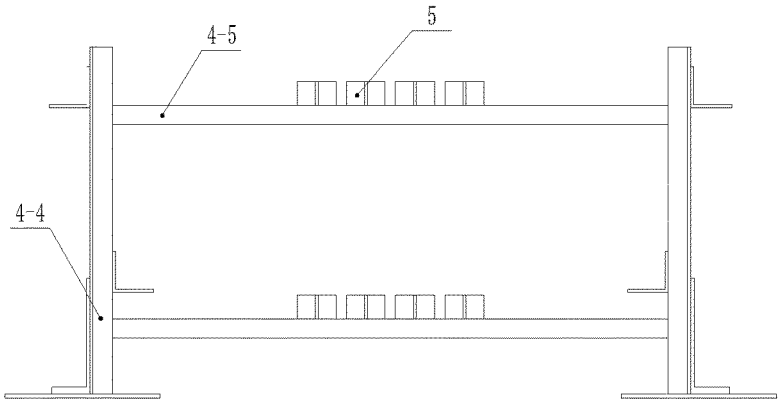
FIG. 2 is a side view of the arrangement of the traction rope lifting device on the guide rail support according to the present invention.
Figure 3:
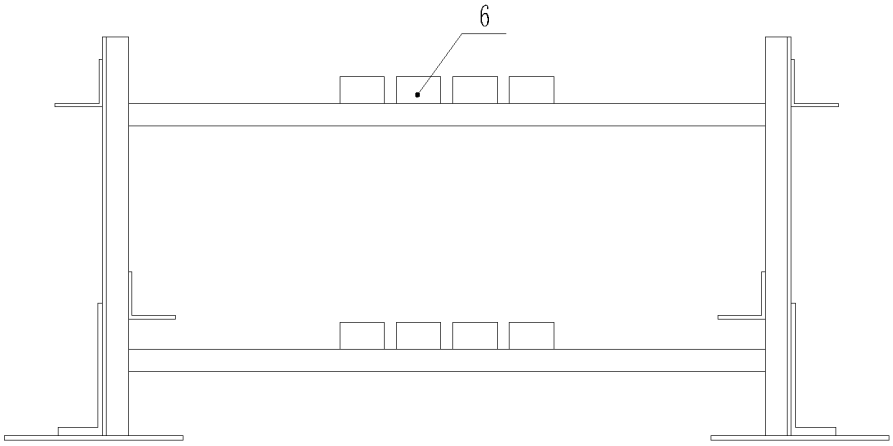
FIG. 3 is a side view of the arrangement of the traction rope pressing device on the guide rail support according to the present invention.
Figure 4:
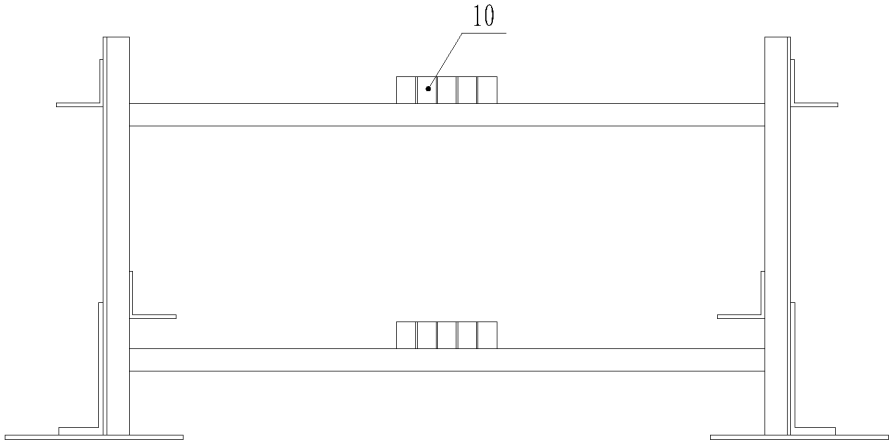
FIG. 4 is a side view of the arrangement of the traction rope guiding device on the guide rail support according to the present invention.

In the figures: 1—bumper; 2—elevator car system; 3—door at slope bottom; 4—slope guide rail system; 5—traction rope lifting device; 6—traction rope pressing device; 7—counterweight system; 8—door at slope top; 9—traction rope; 10—traction rope guiding device; 11—traction machine; 12—governing rope governor; 13—traction rope guiding wheel; 14—governing rope pressing device; 15—governing rope; 16—governing rope lifting device; 17—safety gear; 18—governing rope tensioner; 2-1—car body; 2-2—automatic leveling assembly; 2-3—pulley block; 2-4—rear guide shoe; 2-5—front guide shoe; 4-1—elevator car guide rail; 4-2—counterweight guide rail; 4-3—guide rail support; 4-4—vertical support plate; 4-5—cross plate; 7-1—rear counter-weight; 7-2—counterweight guide shoe; 7-3—front counterweight; 8-1—door opener; 8-2—door; 8-3—sill.

DETAILED DESCRIPTION OF THE EMBODIMENTS

Hereunder the present invention will be detailed in an embodiment with reference to the accompanying drawings.

The slope-adaptive inclined special elevator according to the present invention mainly comprises a bumper 1, an elevator car system 2, a door at slope bottom 3, a slope guide rail system 4, traction rope lifting devices 5, traction rope pressing devices 6, a counterweight system 7, a door at slope top 8, a traction rope 9, traction rope guiding devices 10, a traction machine 11, a governing rope governor 12, a traction rope guiding wheel 13, governing rope pressing devices 14, a governing rope 15, governing rope lifting devices 16, a safety gear 17, and a governing rope tensioner 18. The slope guide rail system 4 is arranged on a slope, and comprises elevator car guide rails 4-1, counterweight guide rails 4-2, and guide rail supports 4-3, each guide rail support 4-3 comprises two vertical support plates 4-4 arranged symmetrically and two cross plates 4-5, an upper cross plate and a lower cross plate, connected between the two vertical support plates, the elevator car guide rails 4-1 are connected and fixed at the two sides of the upper cross plates of the plurality of guide rail supports 4-3, and the counterweight guide rails 4-2 are connected and fixed at the two sides of the lower cross plates; the elevator car system 2 is arranged on the elevator car guide rails 4-1 and operates in a horizontal attitude, the counterweight system 7 connected with the elevator car system 2 is arranged on the upper counterweight guide rails 4-2, the traction rope lifting devices 5 are arranged on the upper and lower cross plates 4-5 of the guide rail supports 4-3 respectively in a start section of the slope, the traction rope pressing devices 6 are arranged on the upper and lower cross plates 4-5 of the guide rail supports 4-3 respectively in an upper section of the slope, and the traction rope guiding devices 10 are arranged on the upper and lower cross plates 4-5 of the last guide rail support 4-3 respectively in the upper section of the slope; forcible guiding is executed via the traction rope lifting devices 5, traction rope pressing devices 6, and traction rope guiding devices 10; the governing rope lifting devices 16 fixed to the ground are arranged beside the guide rail supports 4-3 in the start section of the slope, the governing rope pressing devices 14 fixed to the ground are arranged beside the guide rail supports 4-3 in the upper section of the slope, the governing rope 15 is arranged above the governing rope lifting devices 16 and below the governing rope pressing devices 14, the upper part of the governing rope 15 is driven by the governing rope governor 12, and the lower part of the governing rope 15 is tensioned by the governing rope tensioner 18;

The elevator car system 2 comprises a car body 2-1, an automatic leveling assembly 2-2, a pulley block 2-3, rear guide shoes 2-4 and front guide shoes 2-5, the pulley block 2-3 is arranged on the bottom of the car body 2-1, and the front guide shoes 2-5 and rear guide shoes 2-4 are arranged below the pulley block 2-3 symmetrically and ride on the elevator car guide rails 4-1; 2-4 guide shoe pulleys are arranged on the front guide shoes and rear guide shoes respectively; the number of guide shoe pulleys may be determined according to the magnitude of the stress. One side of the front end between the car body 2-1 and the pulley block 2-3 is hinged to each other, the rear end of the car body 2-1 is connected with the automatic leveling assembly 2-2, the bottom of the pulley block 2-3 is connected with one end of the traction rope 9, and the other end of the traction rope 9 is connected with the counter-weight system 7. The safety gear 17 is arranged on the bottom of the elevator car system 2 and is connected with one end of the traction rope 9, the bottom of the counter-weight system 7 is connected with the other end of the traction rope 9, and the traction rope 9 is driven by the traction machine 11;

The traction machine 11 is arranged at the top of the slope, and drives the traction rope 9 to lead the elevator car system 2 to move upwards or downwards, the governing rope governor 12 and a traction rope guiding wheel 13 are arranged at the traction machine 11, and the traction rope 9 controls the distance between the elevator car system 2 and the counter-weight system 7 via the traction rope guiding wheel 13; the bumper 1 is arranged at the lower end of the slope guide rail system 4, and the door at slope bottom 3 corresponding to the elevator car system 2 when the elevator car system 2 lands at the bottom part of the slope and the door at slope top 8 corresponding to the elevator car system 2 when the elevator car system 2 lands at the top part of the slope are arranged at one side of the slope guide rail system 4;

The counter-weight system 7 comprises a rear counter-weight 7-1, a front counter-weight 7-3, and a counter-weight guide shoe 7-2, the rear counter-weight 7-1 is hinged with the front counter-weight 7-3, and the counter-weight guide shoe 7-2 is fixedly connected on the bottom of the counter-weight system 7;

The door at slope bottom 3 and the door at slope top 8 comprise a door opener 8-1, a door 8-2 arranged below the door opener 8-1, and a sill 8-3 arranged on the bottom of the door 8-2 respectively, and the door 8-2 can slide on the sill 8-3;

Working principle: In the slope-adaptive inclined special elevator according to the present invention, the two ends of the traction rope 9 are connected to the elevator car system 2 and the counterweight system 7 respectively, and the traction rope 9 is towed and lifted under the driving action of the traction machine 11 and the guiding action of the traction rope guiding wheel 13; over-speed protection is realized by means of the governing rope governor 12 and the safety gear 17 linkage and the bumper 1; to adapt to slope variations, the car body 2-1 is leveled automatically by means of the automatic leveling assembly 2-2; the traction rope 9 is guided forcibly via the traction rope lifting devices 5 and the traction rope pressing devices 6, and the governing rope 15 is guided forcibly via the governing rope lifting devices 16 and the governing rope pressing devices 14, thus, the inclined elevator can operate along variable slope-rails, and the entire inclined elevator system can operate successfully in variable-slope occasions.

The invention claimed is:

1. A slope-adaptive inclined special elevator, comprising: a slope guide rail system arranged on a slope, an elevator car system, a counterweight system, traction rope lifting devices, traction rope pressing devices, a traction rope, traction rope guiding devices, a traction machine, a governing rope governor, governing rope pressing devices, a governing rope, governing rope lifting devices, and a governing rope tensioner; wherein the slope guide rail system comprises a plurality of guide rail supports arranged at an interval on the slope, wherein each guide rail support comprises two vertical support plates arranged symmetrically and two cross plates, composed of an upper cross plate and a lower cross plate, connected between the two vertical support plates, elevator car guide rails are connected and fixed at two sides of the upper cross plates of the plurality of guide rail supports, and counterweight guide rails are connected and fixed at two sides of the lower cross plates;

the elevator car system is arranged on the elevator car guide rails and operates in a leveled attitude, the counterweight system connected to the elevator car system is arranged on a top of the counterweight guide rails, the traction rope lifting devices are arranged on the two cross plates of the guide rail supports respectively in a start section of the slope, the traction rope pressing devices are arranged on the two cross plates of the guide rail supports respectively in an upper section of the slope, and the traction rope guiding devices are arranged on the two cross plates of a last guide rail support respectively in the upper section of the slope; the elevator car system is driven via the traction rope lifting devices, the traction rope pressing devices, and the traction rope guiding devices;

the elevator car system comprises a car body and a pulley block arranged on a bottom of the car body, wherein front guide shoes and rear guide shoes are arranged below the pulley block, the front guide shoes and the rear guide shoes ride on the elevator car guide rails, one side of a front end between the car body and the pulley block is hinged to each other, a rear end of the car body is connected to an automatic leveling assembly, a bottom of the pulley block is connected to a first end of the traction rope, and a second end of the traction rope is connected to the counterweight system;

the traction machine is arranged at a top of the slope, and drives the traction rope to lead the elevator car system to move upwards or downwards, the governing rope governor and a traction rope guiding wheel are arranged at the traction machine, and the traction rope maintains a distance between the elevator car system and the counterweight system via the traction rope guiding wheel; a door at a bottom part of the slope corresponding to the elevator car system when the elevator car system lands at the bottom part of the slope and a door at the top part of the slope corresponding to the elevator car system when the elevator car system lands at the top part of the slope are arranged at a first side of the slope guide rail system, the governing rope lifting devices and the governing rope pressing devices are arranged at a second side of the slope guide rail system and are fixed to a ground, the governing rope is arranged above the governing rope lifting devices and below the governing rope pressing devices and forms a closed loop, an upper part of the governing rope is driven by the governing rope governor, and a lower part of the governing rope is tensioned via the governing rope tensioner.

2. The slope-adaptive inclined special elevator according to claim 1, wherein a safety gear linkage is arranged on a bottom of the elevator car system.

3. The slope-adaptive inclined special elevator according to claim 1, wherein a bumper is arranged at a lower end of the slope guide rail system.

4. The slope-adaptive inclined special elevator according to claim 1, wherein the counterweight system comprises a rear counterweight, a front counter-weight hinged to the rear counterweight, and counterweight guide shoes arranged on a bottom of the rear counterweight and a bottom of the front counterweight respectively.

* * * * *